US008807739B2

(12) United States Patent
Okamoto

(10) Patent No.: US 8,807,739 B2
(45) Date of Patent: Aug. 19, 2014

(54) RECORDING APPARATUS

(75) Inventor: Katsumi Okamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 110 days.

(21) Appl. No.: 13/587,405

(22) Filed: Aug. 16, 2012

(65) Prior Publication Data

US 2013/0050378 A1 Feb. 28, 2013

(30) Foreign Application Priority Data

Aug. 26, 2011 (JP) ..... 2011-184951

(51) Int. Cl.
*B41J 2/01* (2006.01)
*B65H 3/44* (2006.01)
*B41J 11/00* (2006.01)

(52) U.S. Cl.
CPC ..... *B41J 11/006* (2013.01)
USPC ..... 347/104; 271/9.08

(58) Field of Classification Search
USPC ..... 271/9.08
See application file for complete search history.

(56) References Cited

U.S. PATENT DOCUMENTS 5,785,308 A * 7/1998 Flores et al. ..... 271/9.11
2009/0035047 A1 * 2/2009 Lee et al. ..... 400/630

FOREIGN PATENT DOCUMENTS

JP 2004-026438 1/2004
JP 2010-253754 11/2010

* cited by examiner

*Primary Examiner* — Matthew Luu
*Assistant Examiner* — Tracey McMillion
(74) *Attorney, Agent, or Firm* — Workman Nydegger

(57) ABSTRACT

There is provided a recording apparatus including an apparatus main body including a first placement portion on which a recording medium is placed, a recording unit which performs recording on the recording medium, and a first transport path through which the recording medium is transported from the first placement portion to the recording unit, an extension unit including a second placement portion, which is detachably attached to the apparatus main body, on which the recording medium is placed, and a second transport path capable of communicating from the second placement portion to the first transport path of the apparatus main body, and a detachable member detachably provided in the apparatus main body and exposing at least a part of the second transport path when detached from the apparatus main body.

8 Claims, 7 Drawing Sheets

RECORDING APPARATUS

BACKGROUND

1. Technical Field

The present invention relates to a recording apparatus, and particularly to a recording apparatus with an apparatus main body to which an extension unit can be attached.

2. Related Art

In the related art, recording apparatuses, each of which is provided with a sheet cassette containing stacked sheets as a kind of recording medium and a recording unit causing a liquid ejecting head, for example, to eject liquid onto the sheet sent from the sheet cassette and transported along a transport path to record images including characters and figures has been put into practical use.

According to some of such recording apparatuses, an extension unit (optional unit) such as an extension case configured as a separate body from an apparatus main body can be attached to and detached from the apparatus main body. In addition, one such extension units is a unit attached to a lower surface side of the apparatus main body and including a sheet cassette, on which sheets to be supplied to the recording unit are stacked and placed, which can be inserted into and pulled out from the unit. The extension unit includes a sending mechanism such as a sheet feeding roller and sends the sheets contained in the sheet cassette one by one from the sheet cassette to the transport path in the recording apparatus.

Incidentally, there are cases where the recording apparatus is brought into a state where a sheet clogs the transport path in the course of being sent from the sheet cassette to the recording unit (also referred to as a "jam state") and the sheet cannot be supplied to the recording unit. In such cases, it is necessary for an operator to perform processing for removing the sheet in the jam state (also referred to as "jam processing"). For example, JP-A-2004-26438 and JP-A-2010-253754 have proposed configurations which have been contrived to facilitate such jam processing.

JP-A-2004-26438 has proposed a configuration in which a sheet sending unit of an extension unit (optional feeder) can be visually recognized from the upper side by pulling the sheet cassette on the side of the apparatus main body from the apparatus main body. According to such a configuration, it is possible to easily perform the jam processing by visually recognizing a sheet in the jam state in a sending mechanism in the extension unit. In addition, JP-A-2010-253754 has proposed a configuration in which a reversing unit can be detached from the apparatus main body. According to such a configuration, it is possible to expose the sheet, which has been sent from the sheet cassette on the side of the apparatus main body and brought into the jam state in the apparatus main body, by detaching the reversing unit from the apparatus main body and to thereby easily perform the jam processing.

In the case of the configuration disclosed in JP-A-2004-26438, however, it is necessary to configure the recording apparatus such that an opening is formed in the apparatus main body in a state where the sheet cassette is pulled out from the apparatus main body. For this reason, it is difficult to apply this configuration to a recording apparatus with a typical configuration in which the circumference of a sheet cassette provided in an apparatus main body is covered with a case body including a sheet transport path and the like formed therein and a sheet supply unit of the extension unit is not exposed even when the sheet cassette is pulled out.

In the case of the configuration disclosed in JP-A-2010-253754, there is a problem in that jam processing cannot be performed for the sheet cassette provided in the extension unit while it is possible to easily perform the jam processing for the sheet cassette provided in the apparatus main body. Accordingly, jam processing is performed for the jam state of the sheet cassette occurring in the extension unit while the extension unit is detached from the apparatus main body. Particularly, when a sheet brought into a jam state inside the sheet cassette provided in the extension unit is removed, it is necessary to detach the extension unit from the apparatus main body. For this reason, a configuration, which can stably maintain a state where the extension unit is attached to the apparatus main body, according to which the operator can immediately and easily detach the extension unit from the apparatus main body when the jam state occurs has been also desired.

SUMMARY

An advantage of some aspects of the invention is to provide a recording apparatus for which it is possible to easily perform jam processing of a recording medium supplied from an extension unit.

According to an aspect of the invention, there is provided a recording apparatus including: an apparatus main body including a first placement portion on which a recording medium is placed, a recording unit which performs recording on the recording medium, and a first transport path through which the recording medium is transported from the first placement portion to the recording unit; an extension unit including a second placement portion, which is detachably attached to the apparatus main body, on which the recording medium is placed, and a second transport path capable of communicating from the second placement portion to the first transport path of the apparatus main body; and a detachable member detachably provided in the apparatus main body and exposing at least a part of the second transport path when detached from the apparatus main body.

With such a configuration, it is possible to remove the recording medium in a jam state from the transport path by detaching the detachable member from the apparatus main body even when the recording medium is brought into the jam state in the second transport path in the extension unit which communicates with the first transport path in the apparatus main body from the second placement portion for the recording medium in the extension unit. Accordingly, it is possible to easily perform jam processing for the recording medium supplied from the extension unit.

In the recording apparatus, the detachable member may configure a third transport path connecting between the first transport path and the second transport path and expose a part of the second transport path and the third transport path when detached from the apparatus main body.

With such a configuration, the recording medium sent from the extension unit is transported to the first transport path through the third transport path configured by the detachable member, and therefore, it is possible to remove the recording medium in the jam state from the transport path by detaching the detachable member from the apparatus main body even when the recording medium is brought into the jam state in the second transport path or the third transport path. Accordingly, it is possible to easily perform the jam processing for the recording medium supplied from the extension unit.

According to another aspect of the present invention, there is provided a recording apparatus including: an apparatus main body including a first placement portion on which a recording medium is placed, a recording unit which performs recording on the recording medium, and a first transport path through which the recording medium is transported from the first placement portion to the recording unit; an extension unit including a second placement portion, which is detachably attached to the apparatus main body, on which the recording medium is placed; and a detachable member detachably provided in the apparatus main body, configuring a transport path connecting between the first transport path and the second placement portion, and exposing at least a part of the transport path connecting between the first transport path and the second placement portion when detached from the apparatus main body.

With such a configuration, it is possible to remove the recording medium in the jam state from the transport path by detaching the detachable member configuring the transport path from the apparatus main body even when the recording medium sent from second placement portion provided in the extension unit to the first transport path in the apparatus main body is brought into the jam state in the transport path connecting between the second placement portion for the recording medium and the first transport path in the apparatus main body. Accordingly, it is possible to easily perform the jam processing for the recording medium supplied from the extension unit.

In the recording apparatus, the recording medium may have recorded surfaces on both front and back sides thereof, and the detachable member may be a reversing unit for reversing the front and back sides of the recorded surfaces of the recording medium transported to the recording medium.

With such a configuration, the detachable member is made to also function as the reversing unit, it is not necessary to separately prepare a detachable member. In addition, since the reversing unit has a region for reversing the recording medium in the apparatus main body, it is possible to form a region from which the recording medium brought into the jam state in the apparatus main body can be easily removed when the reversing unit is detached.

In the recording apparatus, the apparatus main body and the extension unit may engage with each other by a plurality of concaved portions and convexed portions fitted into the concaved portions, relative displacement in the direction in which the extension unit is detached from the apparatus main body may be permitted, and relative displacement in a direction perpendicular to the direction in which the extension unit is detached may be restricted, between the concaved portions and the convexed portions in a state where the extension unit is attached to the apparatus main body.

With such a configuration, a state in which the extension unit is attached to the apparatus main body is stably maintained without displacement in a direction perpendicular to the direction in which the extension unit is detached from the apparatus main body. On the other hand, since the displacement in a detachment direction, namely a direction opposite to the attachment direction, is always permitted, it is possible to immediately detach the extension unit from the apparatus main body every time the jam state occurs (without a particular operation of releasing a lock, for example).

In the recording apparatus, the extension unit may be provided with a connection terminal establishing electrical continuity with the apparatus main body when attached to the apparatus main body and a guide protrusion, which is for positioning the connection terminal with respect to the apparatus main body, near the connection terminal.

With such a configuration, the guide protrusion guides the connection terminal to an appropriate position with respect to the apparatus main body when the extension unit is attached to the apparatus main body. Accordingly, it is possible to reliably establish electrical continuity between the extension unit and the apparatus main body when the extension unit is detached for the jam processing and attached again.

In the recording apparatus, the convexed portions of the extension unit may each have a cylindrical shape with a tapered leading end on the side of the direction in which the extension unit is attached to the apparatus main body.

With such a configuration, the convexed portions can be easily fitted into the concaved portions by the tapered portions for starting the fitting, and movement in a direction perpendicular to the attachment direction is restricted since parts other than the tapered portions are fitted into the concaved portion after the completion of the fitting. In addition, since movement in the direction opposite to the attachment direction is always permitted, it is possible to move the extension unit in the direction opposite to the attachment direction and easily detach the extension unit from the apparatus main body.

In the recording apparatus, the extension unit may be attached to the apparatus main body on the side of the weight direction, and the extension unit may include the convexed portions formed at opposed positions with the gravity center of the projection shape of the attachment part, to which the extension unit is attached to the apparatus main body, in the direction opposite to the weight direction interposed therebetween.

With such a configuration, the convexed portions provided at the opposed positions with the gravity center interposed therebetween positions the extension unit with respect to the apparatus main body, and therefore, the extension unit is attached to the apparatus main body in a stable state in which the displacement of the gravity center in the horizontal direction is suppressed.

In the recording apparatus, the apparatus main body may include a first spatial region, which opens in both the weight direction and the horizontal direction perpendicular to the weight direction, provided in a concaved manner at opposed positions with the gravity center of the projection shape of the attachment part, to which the extension unit is attached, in the weight direction interposed therebetween, namely the positions corresponding to the end portions of the projection shape, and the extension unit may include a second spatial region provided in a concaved manner so as to open in both the direction opposite to the weight direction and the horizontal direction such that a spatial region continues from the first spatial region in the weight direction.

With such a configuration, it is possible to form handhold portions with spatial regions which the operator can easily hold for lifting the apparatus main body in the direction opposite to the weight direction in order to detach the extension unit positioned on the side of the weight direction from the apparatus main body. In addition, since the apparatus main body is lifted at opposed positions with the gravity center interposed therebetween for lifting the apparatus main body in the direction opposite to the weight direction, it is possible to easily lift the apparatus main body in the right upward direction in a state where inclination with respect to the vertical direction is suppressed. Accordingly, it is possible to reduce the amount the apparatus main body is lifted for separating the extension unit from the apparatus main body and to thereby easily detach the extension unit from the apparatus main body.

In the recording apparatus, each of the convexed portions may be positioned near the first spatial region in the horizontal direction in a state where the extension unit is attached to the apparatus main body.

With such a configuration, fitting parts between the convexed portions and the concaved portions are formed near the handholds in the horizontal direction, and therefore, it is possible to smoothly release the fitting state without prying open the fitting between the convexed portions and the concaved portions when the apparatus main body is lifted, for example.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
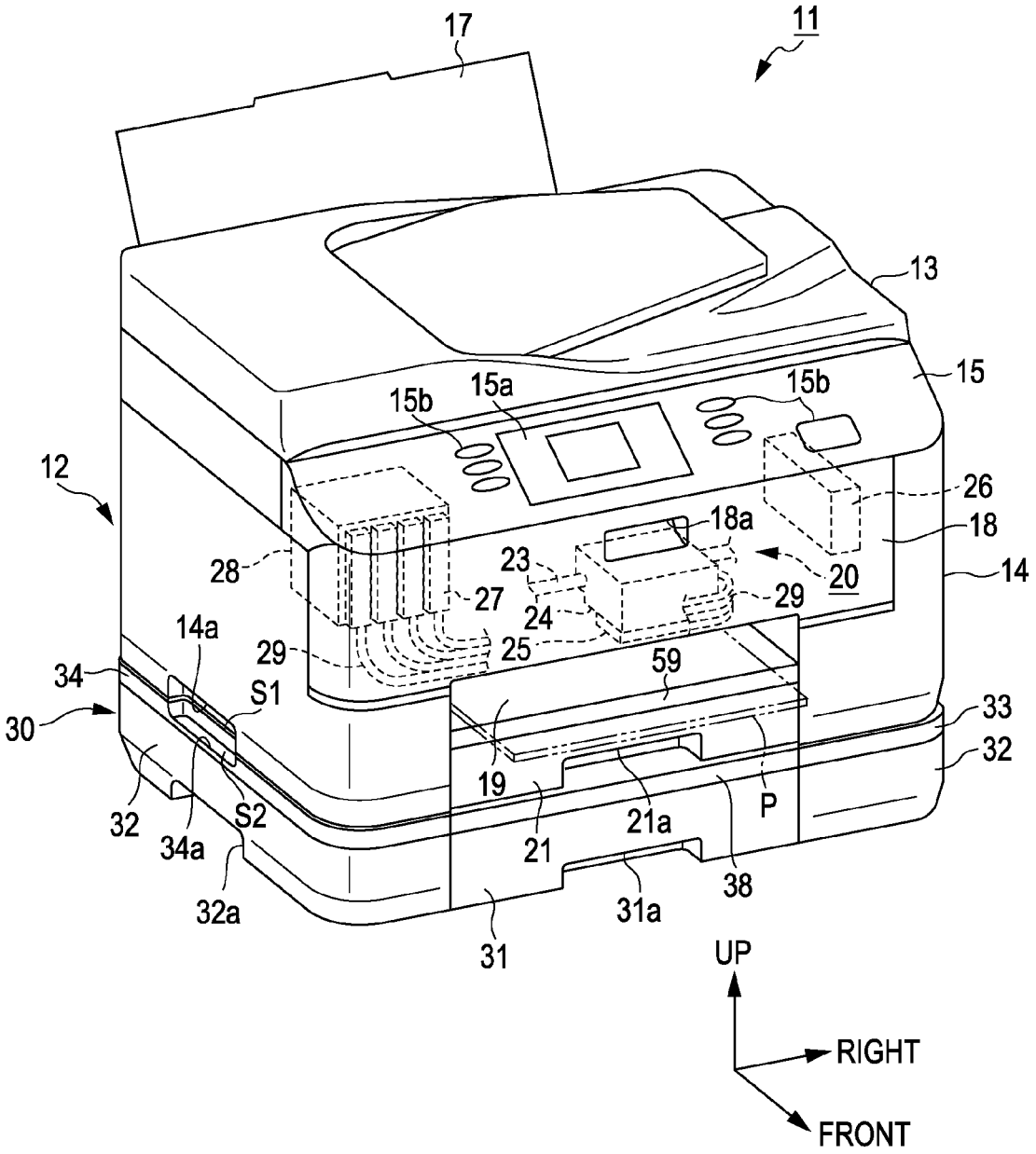
FIG. 1 is a perspective view of a recording apparatus according to an embodiment of the invention when viewed from a front and diagonally left upper position.

Description will be given of recording apparatus, which is a multifunction machine integrally including an image reading device for reading images and a liquid ejecting device provided with a liquid ejecting head for ejecting liquid, which ejects the liquid onto a recording medium to record images, according to an embodiment of the invention with reference to the drawings. To simplify the following description, the weight direction in the vertical direction will be referred to as the downward direction, and a direction opposite to the weight direction will be referred to as the upward direction, as shown in FIG. 1. In addition, a transport direction, which intersects the upward and downward directions, in which a sheet P as a kind of recording medium is transported during image recording, will be referred to as the forward direction, and a direction opposite to the transport direction will be referred to as the backward direction. Furthermore, directions, which intersect both the vertical direction and the transport direction, in which a liquid ejecting head 25 reciprocates, will be referred to as the right direction and the left direction when viewed from the forward direction.

As shown in FIG. 1, a recording apparatus 11 includes an apparatus main body 12 and an extension unit 30 as an extension case for the apparatus main body 12 of the recording apparatus 11. The apparatus main body 12 is provided with a recording unit 20 which functions as an ink-jet printer (also simply referred to as a "printer") as an example of the liquid ejecting device and an image reading unit 13 which functions as an image reading device disposed in the upper portion of the apparatus main body 12. In addition, the apparatus main body 12 includes the recording unit 20 in a device case 14 thereof as a case body configured by a plurality of members, and is integrally formed with the image reading unit 13.

On the upper side of a front surface of the device case 14, an operation panel 15 is arranged for operating the recording unit 20 and the image reading unit 13. The operation panel 15 is provided with a display unit 15*a* (a liquid crystal display, for example) for displaying a menu screen and the like and operation units 15*b* provided on both horizontal sides of the display unit 15*a*.

In the device case 14, a front cover 18 is attached to the lower side of the operation panel 15 so as to be freely openable and closable. The front cover opens towards a user via a hinge on the lower side of the cover, which is not shown in the drawing. In addition, the front cover 18 is provided with a grip portion 18*a* with a concave shape, which the user holds with a hand for opening or closing the front cover 18. In addition, a sheet discharge port 19 for discharging the sheet P discharged from the recording unit 20 to the outside of the apparatus main body 12 opens on the lower side of the front cover 18 of the device case 14. Furthermore, a discharged sheet table 59 is arranged below the sheet discharge port 19.

The recording unit 20 which functions as a printer ejects liquid onto the sheet P and records images. That is, a guide shaft 23 extending in the horizontal direction (this will be also referred to as a "main scanning direction") is installed in the device case 14. In addition, a carriage 24 is supported by the guide shaft 23 in a movable state along the main scanning direction. The carriage 24 is driven by a carriage motor, which is not shown in the drawing, and reciprocates in the main scanning direction. Moreover, a liquid ejecting head 25 for ejecting ink as an example of the liquid onto the sheet P to record (print) images is supported on the side of the lower surface of the carriage 24. In addition, a substrate unit 26 configured with a drive circuit which displaces the liquid ejecting head 25 by displacing the carriage 24 and drives the liquid ejecting head being displaced to eject the ink is disposed at a right end portion of a displacement region of the carriage 24 along the main scanning direction.

On the other hand, a plurality of (four in this embodiment) ink cartridges 27 containing ink to be supplied to the liquid ejecting head 25 are disposed at a left end portion of the displacement region of the carriage 24 along the main scanning direction. In addition, a cartridge holder 28 to which the ink cartridges 27 are detachably attached and ink supply tubes 29 for supplying ink from the side of the cartridge holder 28 to the side of the carriage 24 are provided. In addition, the ink cartridges 27 are detachable from the cartridge holder 28 in a state where the front cover 18 of the device case 14 is opened.

Incidentally, in the recording apparatus 11, the sheet P on which recording is performed is supplied from both the apparatus main body 12 and the extension unit 30 to the recording unit 20 with the above configuration through the transport path formed in the apparatus main body 12. In addition, the transport path will be described later with reference to FIG. 3.

First, the apparatus main body 12 includes a sheet cassette 21 as a first placement portion, on which the sheets P are placed in a stacked state, on the lower side of the sheet discharge table 59, and the contained and stacked sheets P are sent one by one from the uppermost sheet P to the transport path, then transported along the transport path, and supplied to the recording unit 20. The sheet cassette 21 can be inserted into and pulled out from the apparatus main body 12, and includes an eave-shaped grip portion 21*a* provided on the front surface side so as to be held with a hand of an operator for pulling the sheet cassette 21 out from the apparatus main body 12, which makes it easier to pull forward the sheet cassette 21 out from the apparatus main body 12. In addition, the apparatus main body 12 includes a placement tray 17 for placing the sheet P provided in the back side of the device case 14, and the sheet P placed on the placement tray 17 is transported from a positioning the course of the transport path, which extends from the sheet cassette 21 to the recording unit 20, along the transport path and supplied to the recording unit 20.

On the other hand, the extension unit 30 is a combination of a lower case 32 and upper cases 33, 34, and 38 and is formed in a box shape. In addition, a sheet cassette 31 as a second placement portion on which the sheet P is placed in a stacked state is provided on the lower side of the upper case 38 at a center between a pair of two left and right upper cases 33 and 34 in the extension unit 30, and the contained and stacked sheets P are sent one by one from the uppermost sheet P to the transport path and fed to the recording unit 20. The sheet cassette 31 can be inserted into and pulled out from the extension unit 30 in the front-back direction and includes an eave-shaped grip portion 31*a* provided on the side of the front surface so as to be held with the hand of the operator for pulling the sheet cassette 31 out from the extension unit 30, which makes it easier to pull forward the sheet cassette 31 out from the extension unit 30.

In the recording apparatus 11, the extension unit 30 can be attached to and detached from the apparatus main body 12. That is, according to this embodiment, the extension unit 30 is attached while stacked on the lower side of the apparatus main body, namely the side of the weight direction, by the operator displacing the apparatus main body 12 in the weight direction from the upper side of the extension unit 30, that is, by lowering the height position of the lifted apparatus main body 12 from the upper side of the extension unit 30. In addition, the extension unit 30 is detached from the apparatus main body 12 by lifting the apparatus main body 12 to the upper side, namely in the direction opposite to the weight direction in a state where the extension unit 30 is attached.

A pair of handholds is provided for the operator holding the apparatus main body 12 with the hands during the attachment and detachment operations. That is, inwardly concaved spatial regions are provided as handholds on both the left and right sides of the lower end portion of the apparatus main body 12, to which the extension unit 30 is attached, and on both the left and right sides of the upper end portion of the extension unit 30, which is attached to the apparatus main body 12.

Specifically, a handhold configuring portion 14*a* opening in both the downward direction and the left direction for forming a first spatial region S1 is provided on the left side of the lower end portion of the device case 14 in the apparatus main body 12 as shown in FIG. 1. On the other hand, a handhold configuring portion 34*a* opening in both the upward direction and the left direction for forming a second spatial region S2 is provided on the left side of the upper end portion of the upper case 34 on the left side among the pair of left and right upper cases 33 and 34 in the extension unit 30. In addition, the handhold configuring portion 14*a* and the handhold configuring portion 34*a* are provided such that the first spatial region S1 and the second spatial region S2 overlap with each other in the vertical direction, and the first spatial region S1 and the second spatial region S2 configure a sequential handhold.

Figure 2:
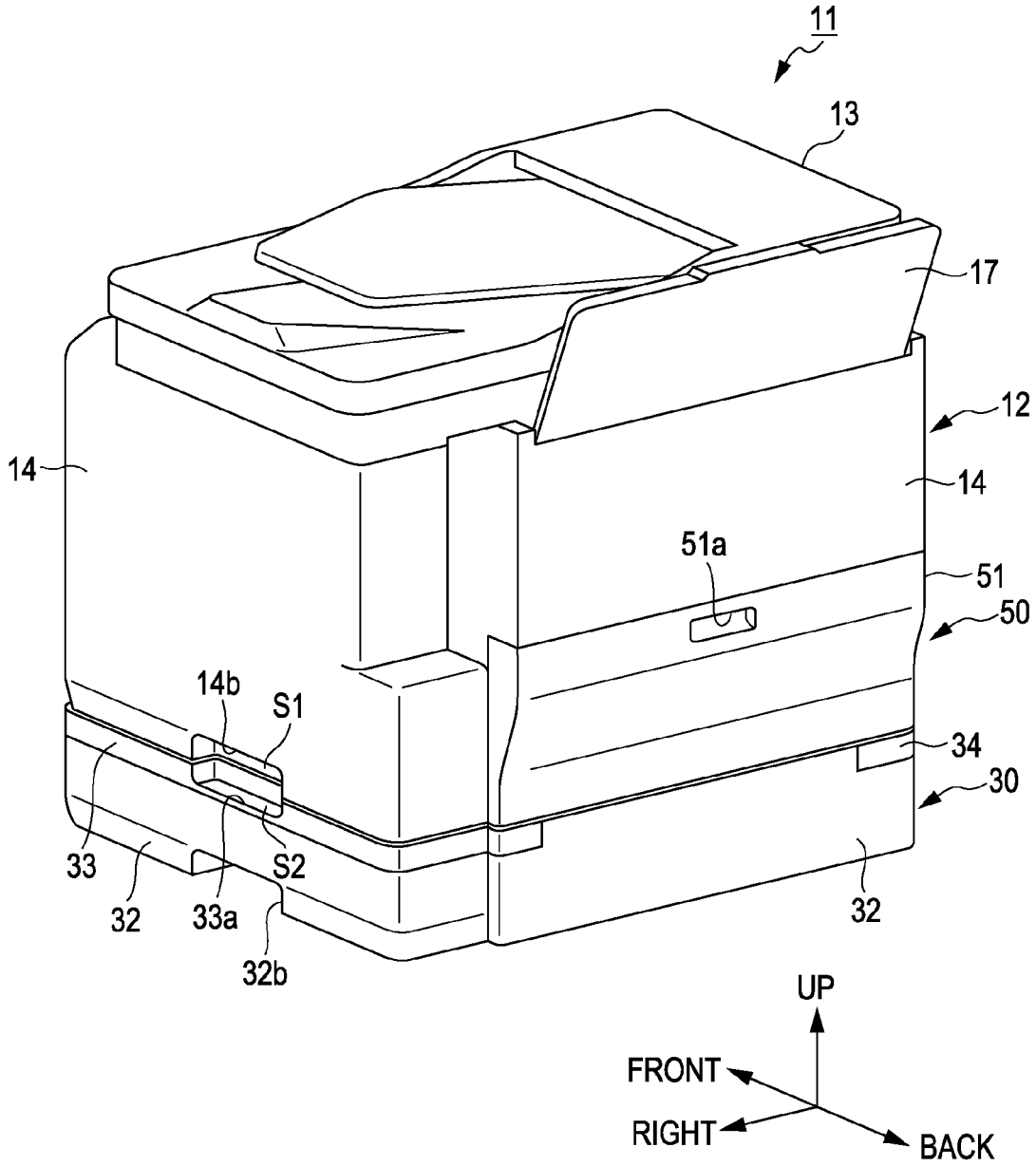
FIG. 2 is a perspective view of the recording apparatus according to the embodiment when viewed from the back and diagonally right upper position.

A handhold configuring portion 14*b* opening in both the downward direction and the right direction for forming the first spatial region S1 is provided on the right side of the lower end portion of the device case 14 in the apparatus main body 12 as shown in FIG. 2. On the other hand, a handhold configuring portion 33*a* opening in both the upward direction and the right direction for forming the second spatial region S2 is provided on the right side of the upper end portion of the upper case 33 on the right side in the extension unit 30. In addition, the handhold configuring portion 14*b* and the handhold configuring portion 33*a* are provided such that the first spatial region S1 and the second spatial region S2 overlap with each other in the vertical direction, and the first spatial region S1 and the second spatial region S2 configure a sequential handhold. In so doing, a pair of left and right handholds is provided in the recording apparatus 11.

As shown in FIGS. 1 and 2, the recording apparatus 11 is further provided with a handhold configuring portion 32*a* and a handhold configuring portion 32*b* on the left side and the right side, respectively, of the lower end portion of the lower case 32 in the extension unit 30. The handhold configuring portion 32*a* opens in both the left direction and the downward direction while the handhold configuring portion 32*b* opens in both the right direction and the downward direction. In addition, spatial regions functioning as handholds when the recording apparatus 11 is lifted while the extension unit 30 is attached to the apparatus main body 12 are formed by the handhold configuring portions 32*a* and 32*b*, respectively. In this embodiment, the shapes of the handhold configuring portion 32*a* and the handhold configuring portion 32*b* are the same as those of the handhold configuring portion 14*a* and the handhold configuring portion 14*b*.

Figure 3:
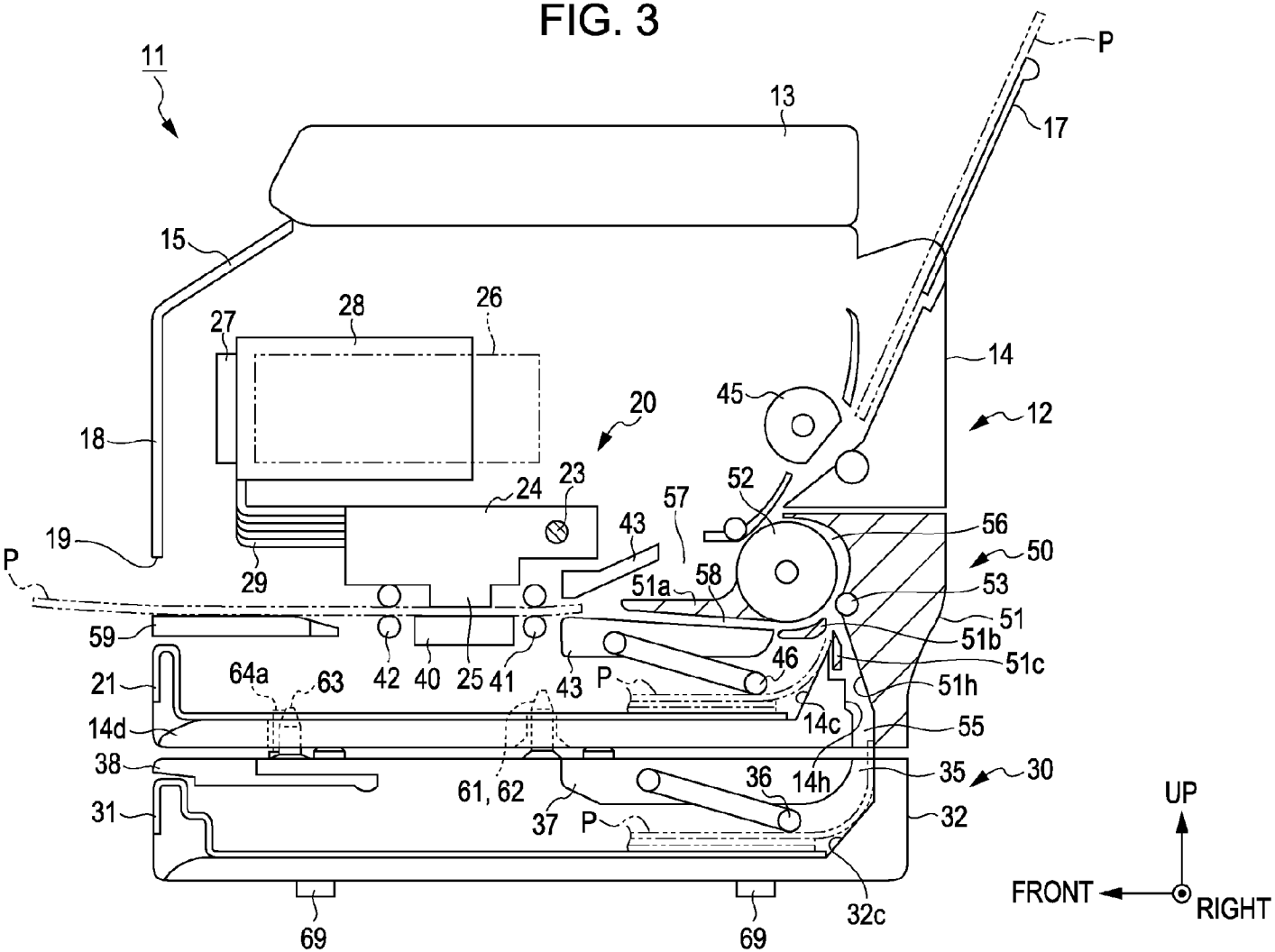
FIG. 3 is a cross-sectional view showing a recording unit and a transport path of a sheet provided in the recording apparatus according to the embodiment.

As shown in FIGS. 2 and 3, the recording apparatus 11 according to this embodiment includes a reversing unit 50 as a detachable member, which is detachably provided in the apparatus main body 12 and separated and detached from the apparatus main body 12 by being pulling backward, on the back side thereof. The reversing unit 50 is a unit configuring a part of a transport path of the sheet P to be supplied to the recording unit 20 and reversing front and back sides of the sheet P, that is, reversing the surface, on which recording is performed, in the transport path in order to perform recording on both sides of the sheet P to be supplied to the recording unit 20. Next, a configuration of the reversing unit 50 and a configuration of a transport path of the sheet P in the recording apparatus 11 will be described with reference to FIG. 3.

As shown in FIG. 3, the reversing unit 50 includes a unit frame 51 (a hatched part in the drawing) whose back surface functions with the device case 14 as a case body of the recording apparatus 11, a reversing roller 52, and a retard roller 53. The reversing roller 52 is axially supported in a rotatable manner by the unit frame 51 about a horizontal shaft line based on a drive force from a drive source, which is not shown in the drawing, to pinch and transport the sheet P with the retard roller 53 which is axially supported in a rotatable manner by the unit frame 51 about a horizontal shaft line in the same manner. In addition, the retard roller 53 functions to allow the reversing roller 52 to transport the sheet P one by one.

In the recording apparatus 11, transport passages 55, 56, 57, and 58 through which the sheet P is transported are configured in a state where the reversing unit 50 is attached to the apparatus main body 12. In addition, a transport path through which the sheet P supplied from the sheet cassette 21 is transported to the recording unit 20 through the transport passages 56 and 57 and then discharged to the sheet discharge table 59 and a transport path through which the sheet P supplied from the placement tray 17 is transported to the recording unit 20 through the transport passage 57 and then discharged to the sheet discharge table 59 are configured in the apparatus main body 12. In addition, a transport passage of the sheet P, through which the sheet P supplied from both the sheet cassette 21 and the placement tray 17 after completing the recording on the front surface is transported again to the recording unit 20 from the recording unit 20 through the transport passages 58, 56, and 57 and then discharged to the sheet discharge table 59 is configured for double-side recording (printing). Accordingly, at least the transport passage 56 corresponds to a first transport path in this embodiment.

The transport passage 55 is configured as a transport path, which allows the opening 35 provided on the back side of the extension unit 30 to communicate with the transport passage 56, from the sheet cassette 31 included in the extension unit 30. Accordingly, the transport passage 55 of this embodiment corresponds to a third transport path, and the opening 35 corresponds to a second transport path. A transport path through which the sheet P supplied from the extension unit 30 through the opening 35 is sent to the transport passage 56 as the first transport path through the transport passage 55 is configured. In addition, the sheet P supplied from the sheet cassette 31 is transported through the transport passage 56 and the subsequent transport passages in the same manner as the sheet P supplied from the sheet cassette 21.

Hereinafter, detailed description of the transport passages 55, 56, 57, and 58 will be sequentially given.

As shown in FIG. 3, the transport passage 55 is a path, through which the sheet P is transported upward, at the lower end portion in the apparatus main body 12, and one surface side of the transported sheet P faces a wall surface of one (front) transport passage in the path while the other surface side of the sheet P faces a wall surface of the other (back) transport passage. The wall surface of the one (front) transport passage in the transport passage 55 is configured by a wall surface portion 14*h* sequentially formed upward from the end portion of the lower surface of the lower portion 14*d* formed at the lower end portion of the device case 14 and a frame part 51*c* formed in front of the unit frame 51 so as to be positioned on a surface extended from the wall surface portion 14*h*. Meanwhile, the wall surface of the other (back) transport passage in the transport passage 55 is configured by a wall surface portion 14*h* configuring the wall surface of the one (front) transport passage and a frame part 51*h* formed on the front surface side of the lower portion of the unit frame 51 so as to face the frame part 51*c* in the front-back direction.

The sheet P contained in the sheet cassette 31 in the extension unit 30 is sent from the sheet cassette 31 to the transport passage 55. That is, the extension unit 30 includes a fixed frame 37 provided on the back upper side and a sheet feeding roller 36 axially supported so as to freely swing on the lower side of the fixed frame 37. The sheet feeding roller 36 sends the sheet P stacked and contained in the sheet cassette 31 from the opening 35 opening in the extension unit 30 on the back upper side to the transport passage 55. In addition, the opening 35 is formed between a separation slope 32*c* formed in the lower case 32 in the extension unit 30 and the fixed frame 37, and the separation slope 32*c* separates and sends the sheets P one by one to the transport passage 55 when a plurality of sheets P move through the opening 35.

As shown in FIG. 3, the transport passage 56 is formed further upward continuously from the transport passage 55 and has a curved shape corresponding to a shape of an outer circumferential surface of the reversing roller 52. The wall surface of the one transport passage (an inner side of the curved shape) in the transport passage 56 is configured by the reversing roller 52 and frame parts formed on both the left and right sides thereof, which is not shown in the drawing. In addition, the inner surface of the other transport passage (outer side of the curved shape) in the transport passage 56 is configured by a frame part 51*h* formed on the front surface side of the unit frame 51 so as to face the outer circumferential surface of the reversing roller 52 configuring the wall surface of the one transport passage (inner side of the curved shape).

The sheet P contained in the sheet cassette 21 in the apparatus main body 12 as well as the sheet P in the extension unit 30, which is transported along the transport passage 55, are sent to the transport passage 56. That is, the sheet feeding roller 46 axially supported by a transport passage configuring member 43, which is formed in the apparatus main body 12, so as to freely swing displaces (lifts) the sheet P stacked and contained in the sheet cassette 21 along the separation slope 14*c* formed on the back side of the lower portion 14*d* of the device case 14. By the displacement along the separation slope 14*c*, one uppermost sheet P is separated and sent from the space between the frame part 51*c* and the frame part 51*b* of the unit frame 51 to the transport passage 56.

In addition, the transport passage 57 is formed so as to face forward sequentially from the curve-shaped transport passage 56, and a wall surface of one (upper) transport passage is configured with a surface, which faces downward, in the transport passage configuring member 43 formed in the apparatus main body 12, as shown in FIG. 3. In addition, a wall surface of the other (lower) transport passage of the transport passage 57 is configured by an upper surface of the frame part 51*a* formed on the front surface side of the unit frame 51. The sheets P placed on the placement tray 17 and transported one by one by the sheet feeding roller 45 as well as the sheets P transported along the transport passage 56 are sent to the transport passage 57. The sheet P sent to the transport passage 57 is pinched by a sheet sending roller pair 41 which is axially supported by the apparatus main body 12 in a rotatable manner and transported to the recording unit 20. In addition, the sheet P, on the recording surface of which recording has been completed by the recording unit 20, is pinched by a sheet discharging roller pair 42 which is axially supported by the apparatus main body 12 in a rotatable manner and discharged from the recording unit 20 to the sheet discharge table 59 (sheet discharge port 19).

According to this embodiment, the sheet sending roller pair 41 and the sheet discharging roller pair 42 are rotated in both the normal and reverse directions by a drive source which is not shown in the drawing. By the rotation, the sheet P is transported in the transport direction (the forward direction in this case) between the liquid ejecting head 25 and a supporting table 40 disposed below the liquid ejecting head 25 for supporting the sheet P in the recording unit 20, returned backward after recording is performed on one side (front side), and transported along the transport passage 58.

The transport passage 58 includes a wall surface of one (lower) transport passage configured by an upper surface of the transport passage configuring member 43 formed in the apparatus main body 12 and a wall surface of the other (upper) transport passage configured by a lower surface of the frame part 51*a* formed on the front surface side of the unit frame 51. The transport passage 58 corresponds to a fourth transport path. The sheet P is transported from the front side to the back side through the transport passage 58 when recording is performed on both front and back sides of the sheet P for double-side printing, for example. That is, the sheet P transported through the transport passage 58 is sent to the transport passage 56 and moved through the curve-shaped transport passage 56 by the rotation of the reversing roller 52. By the movement through the transport passage 56, the movement direction of the sheet P is reversed from backward to forward and brought into a state where the front side and the back side are reversed when the sheet P is sent again to the transport passage 57.

As described above, the reversing unit 50 configures the transport passages 56 to 58 as a reversing path reversing the front and back sides of the sheet P in the transport path of the sheet P, which is formed in the apparatus main body 12, and configures a wall surface of one transport passage of the transport passage 55 as a part of the transport path of the sheet P sent from the sheet cassette 31 in the extension unit 30.

Incidentally, the recording apparatus 11 has a configuration in which the extension unit 30 can be attached to and detached from the apparatus main body 12 as described above. According to this embodiment, convexed portions 61 and 62 protruding upward are provided in the extension unit 30, and the convexed portions 61 and 62 are inserted and fitted into concaved portions 16*a* and 16*b* (see FIG. 4B) provided in the lower portion 14*d* of the device case 14 at attachment parts in the apparatus main body 12, to which the extension unit 30 is attached, as shown in FIG. 3. By the fitting, the extension unit 30 is attached to the apparatus main body 12 while stacked on the lower side, namely the side of the weight direction of the apparatus main body 12. In addition, fitting in this embodiment includes a state where an enough gap is present between the convexed portion 61 and 62 and the concaved portion 16*a* and 16*b* to allow relative displacement of the apparatus main body 12 with respect to the extension unit 30 in the horizontal direction within a range in which recording processing on the sheet P is not disturbed in the recording apparatus 11 (air-gap fitting).

In addition, the extension unit 30 is provided with a guide protrusion 63 which will be described later, and electrical continuity is established between the extension unit 30 and the apparatus main body 12 by inserting the guide protrusion 63 and a connection terminal 64*a* positioned near the guide protrusion 63 in the apparatus main body 12 while the extension unit 30 is attached. By the electrical continuity, the sheet feeding roller 36 of the extension unit 30 is operated by an electric signal from the side of the apparatus main body 12, and a sending operation of the sheet P from the sheet cassette 31 in the extension unit 30 to the transport passage 55 becomes available.

Next, description will be given of an attachment structure between the apparatus main body 12 and the extension unit 30 with reference to FIGS. 4A, 4B, 4C, 5A, and 5B. In FIGS. 4A, 4B, 4C, 5A, and 5B, same reference numerals will be given to the components described above, and the description thereof will be omitted.

Figure 4B:
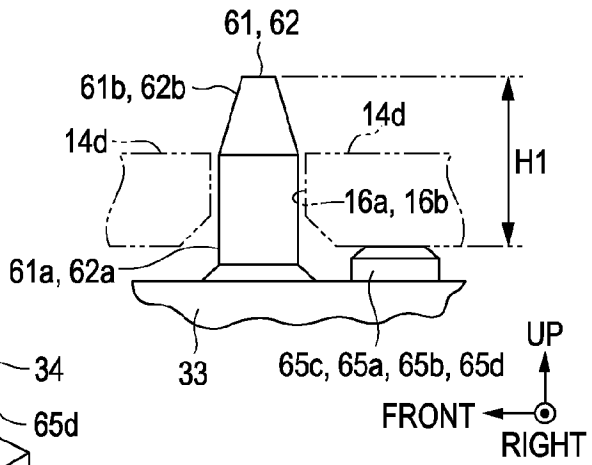
FIG. 4B is a configuration diagram of a convexed portion and a contact portion brought into contact with an apparatus main body.
Figure 4C:
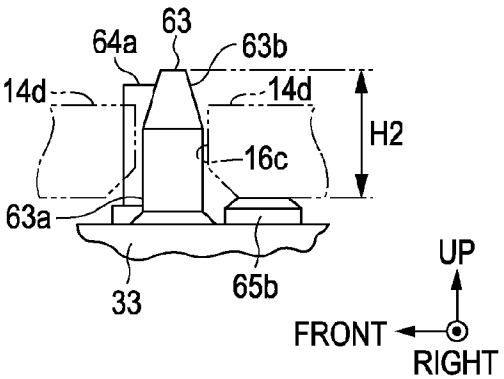
FIG. 4C is a configuration diagram of a guide protrusion for positioning a connection terminal.
Figure 4A:
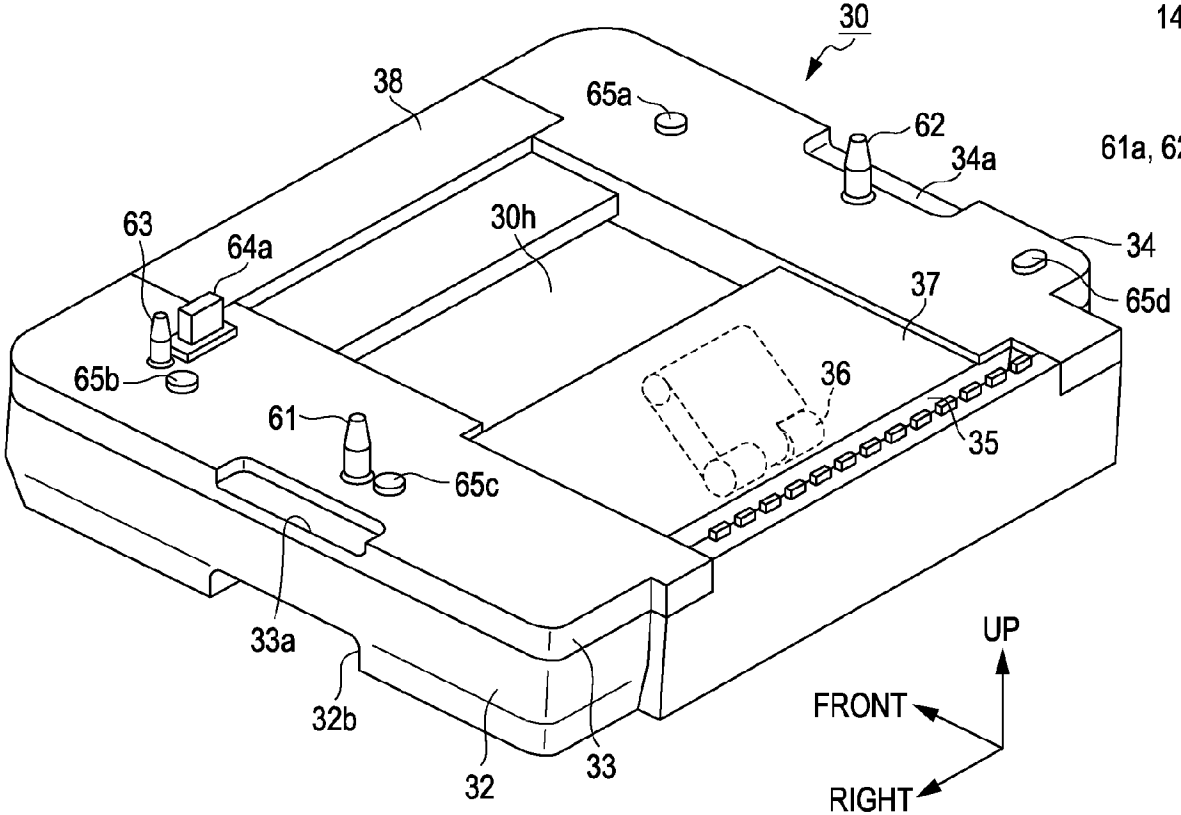
FIG. 4A is a perspective view showing a configuration of an extension unit.

As shown in FIG. 4A, an opening 30*h* through which the inside of the sheet cassette 31 can be visually recognized from the upper side is provided at the center in the upper surface of the upper portion of the extension unit 30. The convexed portion 61 and the convexed portion 62 protruding upward near the horizontal direction (the left direction in this case) of the handhold configuring portion 33*a* and near the horizontal direction (the right direction in this case) of the handhold configuring portion 34*a* are formed on the upper surfaces of the upper case 33 and the upper case 34 arranged on the right side and the left side of the opening 30*h*, respectively. Similarly, four contact portions 65*a*, 65*b*, 65*c*, and 65*d* brought into contact with the lower surface of the lower portion 14*d* of the device case 14 of the apparatus main body 12 from the lower side are formed in a distributed arrangement state in the extension unit 30. In addition, the contact portion 65*d* has an oval contact surface, and the other contact portions 65*a*, 65*b*, and 65*c* have circular contact surfaces.

According to this embodiment, the convexed portion 61 and the contact portions 65*b* and 65*c* are integrally formed with the lower case 32 and formed so as to project upward from the upper case 33 through openings, which are not shown in the drawing, formed in the right upper case 33 individually corresponding to the convexed portion 61 and the contact portions 65*b* and 65*c*. In addition, the convexed portion 62 and the contact portions 65*a* and 65*d* are integrally formed with the lower case 32 and formed so as to project upward from the upper case 34 through openings, which are not shown in the drawing, formed in the left upper case 34 individually corresponding to the convexed portion 62 and the contact portions 65*a* and 65*d*. Moreover, the convexed portions 61 and 62 further protrude to the side of the apparatus main body 12 as compared with the contact portions 65*a*, 65*b*, 65*c*, and 65*d* and engage with the apparatus main body 12 by predetermined amounts in the vertical direction.

That is, the convexed portion 61 (62) is formed so as to protrude upward to a position which is higher than that of the contact portion 65*c* (65*a*, 65*b*, 65*d*) by a dimension H1 as shown in FIG. 4B. Then, the convexed portions 61 and 62 are inserted into the concaved portion 16*a* (16*b*) provided as through-holes penetrating the lower portion 14*d* of the device case 14 of the apparatus main body 12 in the vertical direction individually corresponding to the convexed portions 61 and 62 and fitted such that the protruding portions, each of which has a protruding part with the dimension H1, engage in the vertical direction. Accordingly, the operator can separate the extension unit 30 from the apparatus main body 12 by lifting the apparatus main body 12 upward by a dimension H1 or more. In other words, the dimension H1 is set to a dimension with which the extension unit 30 is unnecessarily separated from the apparatus main body 12. In addition, the dimension H1 is set to about 3 to 6 cm in this embodiment. Moreover, the convexed portions 61 and 62 have a configuration in which relative movement in a direction in which fitting is released and the extension unit 30 is detached is always allowed in a state where the convexed portions 61 and 62 are fitted into the concaved portions 16*a* and 16*b*.

In addition, the concaved portions 61 (62) is formed into a shape that the circular part 61*a* (62*a*) continues from the lower side of the tapered portion 61*b* (62*b*) tapered on the upper side as shown in FIGS. 4A and 4B. On the other hand, the concaved portion 16*a* (16*b*) is formed into a circular hole shape whose opening edge of the through-hole on the lower side of the lower portion 14*d* is chamfered. Accordingly, the convexed portion 61 (62) is fitted in a state where the movement thereof in the horizontal direction is restricted while the tapered portion 61*b* is guided by the chamfered portion of the opening edge and inserted into the concaved portion 16*a* (16*b*) and the cylindrical portion 61*a* is subsequently inserted.

As shown in FIGS. 4A and 4C, the extension unit 30 of this embodiment includes the guide protrusion 63, which is for positioning the connection terminal 64*a* with respect to the apparatus main body 12, provided near the right side of the connection terminal 64*a*. The guide protrusion 63 is formed into a shape that a cylindrical portion 63*a* continues on the lower side of a tapered portion 63*b* tapered on the upper side. In addition, a circular hole-shaped concaved portion 16*c* which has a chamfered lower end and penetrates in the vertical direction is formed at a position, which corresponds to the guide protrusion 63, in the lower portion 14*d* of the apparatus main body 12. The guide protrusion 63 is fitted in a state where the movement in the front-back and horizontal directions is restricted while the cylindrical portion 63*a* is guided by the chamfered portion and inserted into the concaved portion 16*c* after the tapered portion 63*b* is inserted thereinto.

In addition, the fitting state between the circular portion 63*a* and the concaved portion 16*c* includes a state where an enough of a gap allowing relative movement in the horizontal direction within a range in which positioning of the connection terminal 64*a* with respect to the apparatus main body 12 is not disturbed is present between the cylindrical portion 63*a* and the concaved portion 16*c*.

In addition, the guide protrusion 63 is formed so as to further project upward as compared with the contact portion 65*b* by a dimension H2 as shown in FIG. 4C. As a result, the guide portion 63 fitted such that the projecting part with the dimension H2 engages with the concaved portion 16*c* provided in the apparatus main body 12 in the vertical direction. According to this embodiment, the dimension H2 is set to be a smaller value than the dimension H1, and the engagement of the guide protrusion 63 with the concaved portion 16*c* in the vertical direction is released before being brought into a state where the extension unit 30 can be detached from the apparatus main body 12 by the operator lifting upward the apparatus main body 12. In addition, the electrical continuity with the connection terminal 64*b* (see FIG. 7) provided in the apparatus main body 12 is released by pulling the connection terminal 64*a* out from the apparatus main body 12 before the release of the engagement.

Next, description will be given of a planar arrangement, namely the positions in the horizontal direction of the convexed portions 61 and 62 and the concaved portions 16*a* and 16*b* at attachment parts at which the extension unit 30 is attached to the apparatus main body 12, with reference to FIGS. 5A and 5B.

Figure 5A:
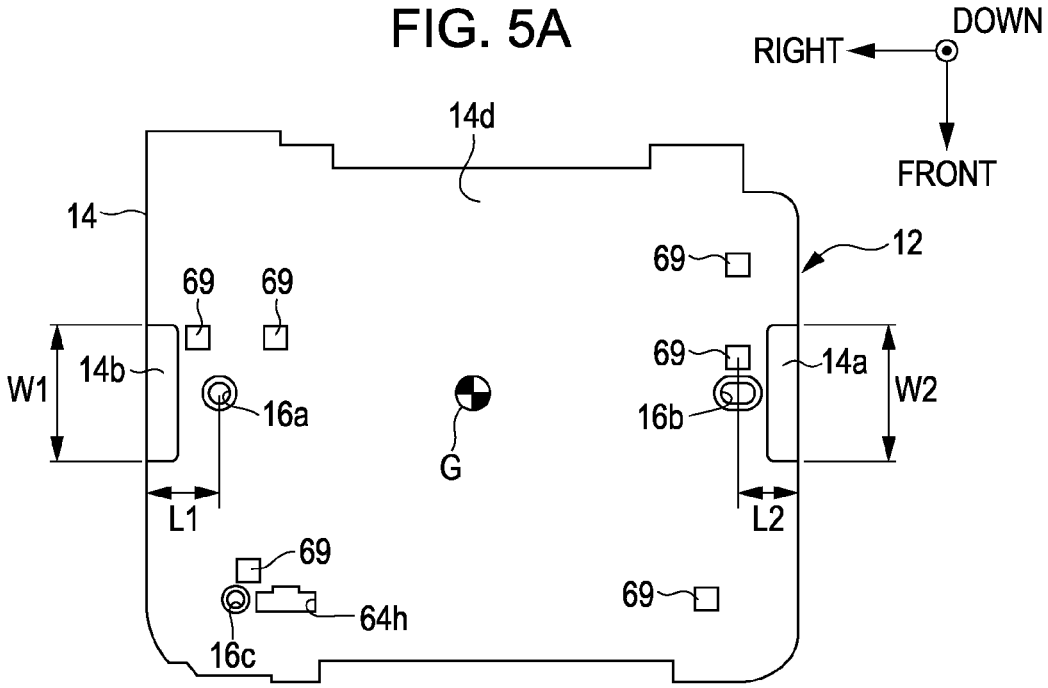
FIG. 5A is a diagram schematically showing a lower portion of the apparatus main body when viewed from the lower side.

As shown in FIG. 5A, the lower portion 14*d* functioning as an attachment part, to which the extension unit 30 is attached, in the apparatus main body 12 has a substantially rectangular projection shape in the downward direction (weight direction). In addition, the handhold configuration portion 14*a* and the handhold configuring portion 14*b* are provided in a concaved manner at positions facing each other with the gravity center G of the projection shape interposed therebetween, namely positions of the left end and the right end of the lower surface of the lower portion 14*d*, respectively. The handhold configuring portion 14*a* is formed to have a width with a length W2 in the front-back direction while the handhold configuring portion 14*b* is formed to have a width with a length W1 in the front-back direction. In addition, the length W1 and the length W2 are the same in this embodiment. Moreover, a length of the handhold configuring portion 14*a* in the horizontal direction is formed to have the same dimension as that of a length of the handhold configuring portion 14*b* in the horizontal direction.

Figure 5B:
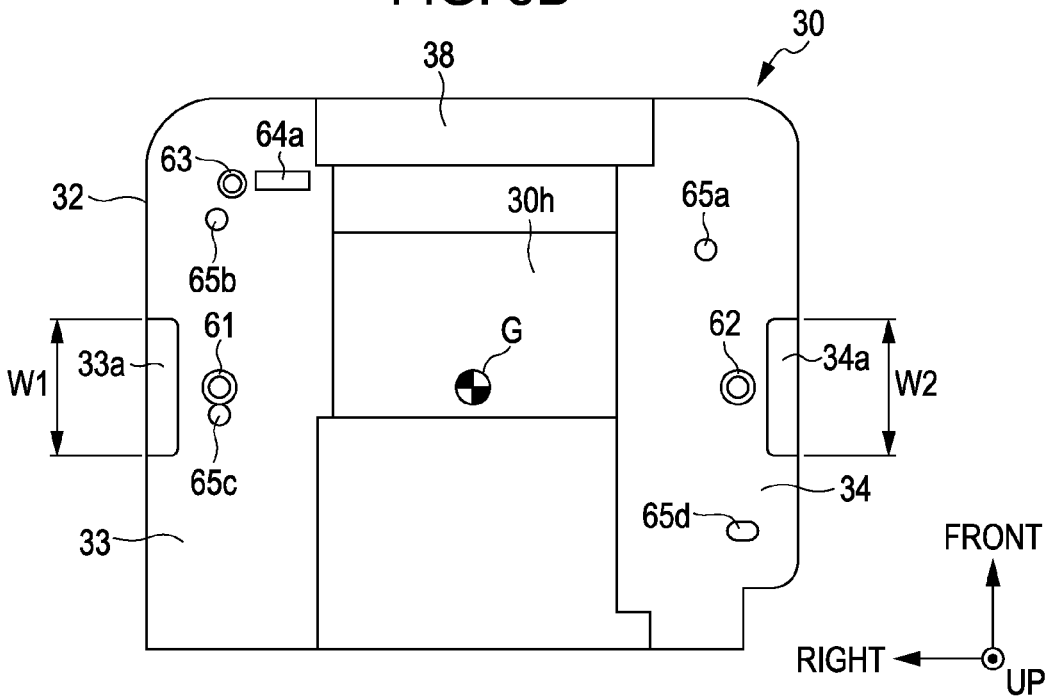
FIG. 5B is a diagram schematically showing an upper portion of the extension unit when viewed from the upper side.

Accordingly, the handhold configuring portion 34*a* with a spatial region which overlaps with the spatial region of the handhold configuring portion 14*a* in the vertical direction is similarly formed to have a width with the length W2 in the front-back direction and formed to have the same dimension as that of the handhold configuring portion 14*a* in the horizontal direction as shown in FIG. 5B. Similarly, the handhold configuring portion 33*a* which overlaps with the handhold configuring portion 14*b* in the vertical direction is similarly formed to have a width with the length W1 in the front-back direction and formed to have the same dimension as that of the handhold configuring portion 14*a* in the horizontal direction.

Furthermore, the upper portion, which functions as an attachment part to the apparatus main body 12, in the extension unit 30 to which the apparatus main body 12 is attached includes an upper surface formed by upper cases 33, 34, and 38 as shown in FIG. 5B. In addition, the projection shape of the upper portion in the upward direction (the direction opposite to the weight direction) is a substantially rectangular shape which substantially overlaps with the projection shape of the lower portion 14*d*. In addition, the convexed portion 61 and the convexed portion 62 are formed at positions facing each other with a gravity center G in the projection shape of the upper portion interposed therebetween, namely positions within the regions of the upper surfaces of the upper case 33 and the upper case 34, respectively.

On the other hand, the concaved portions 16*a* and 16*b* into which the convexed portions 61 and 62 are fitted are provided in the lower portion 14*d* of the device case 14 on the side of the apparatus main body 12 as shown in FIG. 5A. According to this embodiment, the concaved portion 16*a* is provided near the handhold configuring portion 14*b* in the horizontal direction, and the concaved portion 16*b* is provided near the handhold configuring portion 14*a* in the horizontal direction, respectively. As a result, the convexed portion 61 fitted into the concaved portion 16*a* is located near the handhold configuring portion 14*b* in the horizontal direction, and the convexed portion 62 fitted into the concaved portion 16*b* is located near the handhold configuring portion 14*a* in the horizontal direction, in a state where the extension unit 30 is attached to the apparatus main body 12.

According to this embodiment, the concaved portion 16*a* is formed at substantially the center of the handhold configuring portion 14*b* in the front-back direction when viewed from the right while the hole center thereof is located at a position separated from the right end of the lower surface of the lower portion 14*d* toward the left side by a dimension L1. In addition, the concaved portion 16*b* is formed at substantially the center of the handhold configuring portion 14*a* in the front-back direction when viewed from the left while the hole center thereof is located at a position separated from the left end of the lower surface of the lower portion 14*d* by a dimension L2. Moreover, the dimension L1 is set to be a larger dimension value than the dimension L2 so as to generate planar deviation between the apparatus main body 12 and the extension unit 30 at the attachment part when the extension unit 30 is not being correctly attached to the apparatus main body 12, namely when the convexed portion 61 is fitted into the concaved portion 16*b*.

According to this embodiment, the concaved portion 16*b* has a hole with an oval shape of which the length in the horizontal direction is slightly longer than the length in the front-back direction in order to absorb a positional error between the convexed portions 61 and 62 and the concaved portions 16*a* and 16*b* as shown in FIG. 5A. In addition, a plurality of (six in this case) main body legs 69 functioning as legs when the apparatus main body 12 is placed without the extension unit 30 attached thereto are attached to the lower surface of the lower portion 14*d*. The main body legs 69 absorb impact when the apparatus main body 12 is placed and functions such that the apparatus main body 12 is stably placed on the placement table. In addition, an opening 64*h* through which the connection terminal 64*a* penetrates when inserted into the apparatus main body 12 is provided in the lower portion 14*d*.

Figure 6:
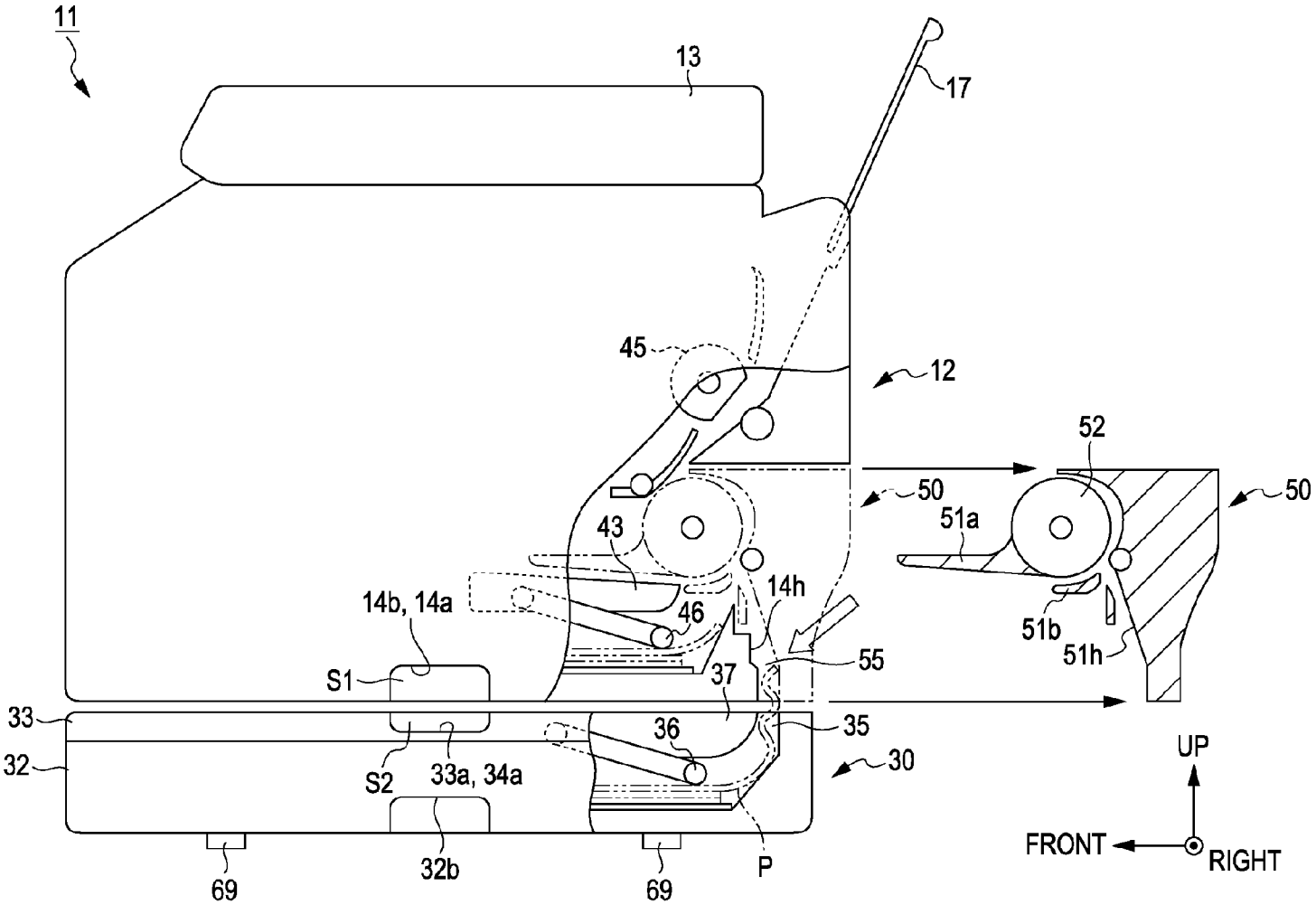
FIG. 6 is a right side view of the recording apparatus from which a reversing unit is pulled out.
Figure 7:
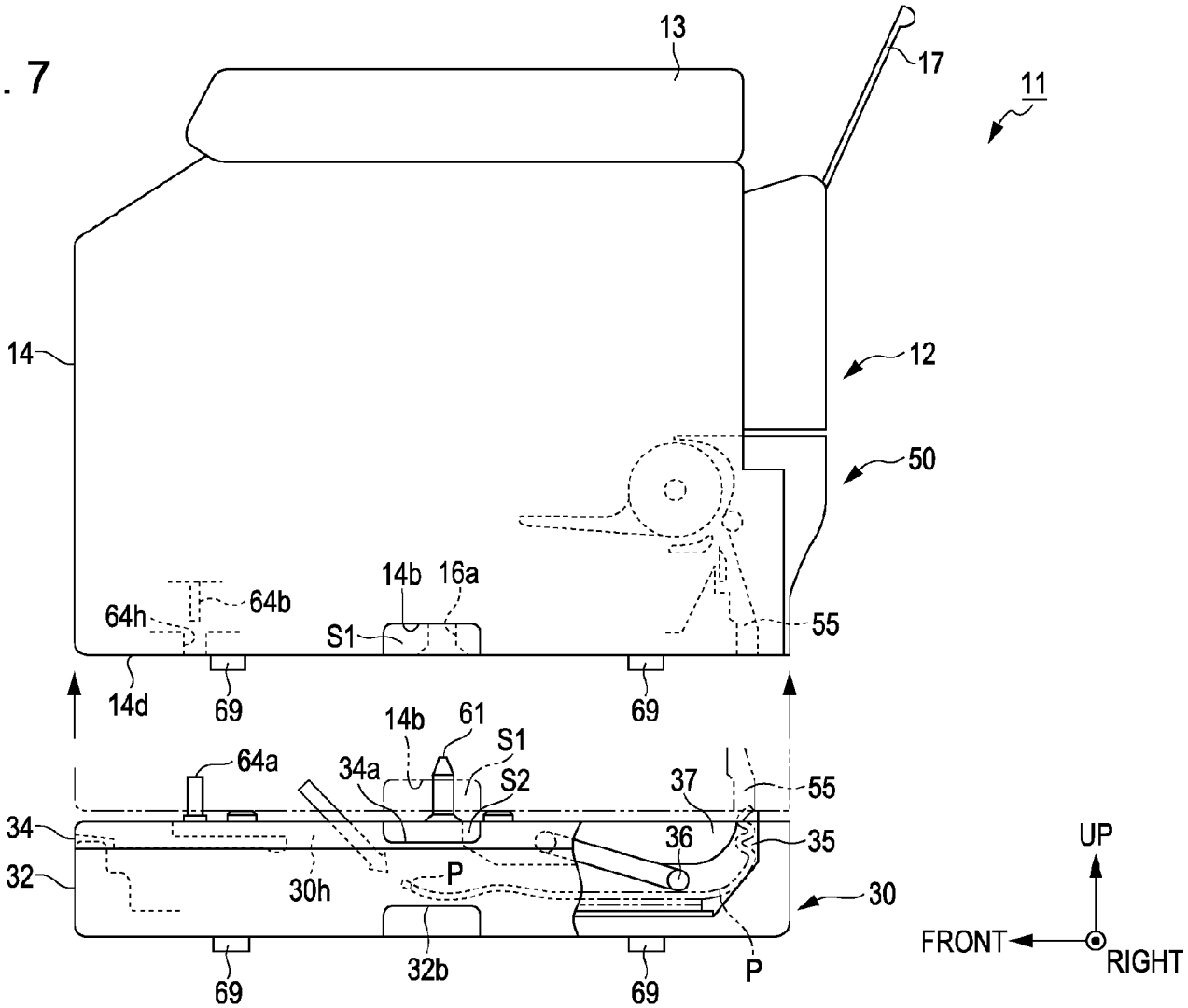
FIG. 7 is a right side view of the recording apparatus, the apparatus main body of which is lifted in a direction opposite to a weight direction, from which the extension unit is detached.

An action in the recording apparatus 11 with the above configuration, namely jam processing when the sheet P supplied from the extension unit 30 is brought into a jam state in the transport path will be described with reference to FIG. 6. In addition, jam processing in the extension unit will be described with reference to FIG. 7. In FIGS. 6 and 7, same reference numerals will be given to the elements described above, and the description thereof will be omitted.

First, when the jam processing is performed for the sheet P in the jam state at the transport passage 55 as a part of the transport path, the operator pulls the reversing unit 50 backward and separates the reversing unit 50 from the apparatus main body 12 as shown in FIG. 6. The reversing unit 50 is slid and moved backward by a sliding mechanism, which is not shown in the drawing, at a position between the reversing unit 50 and the apparatus main body 12 and completely pulled out from the apparatus main body 12. As a result, the frame part 51*h* as the wall surface of one transport passage of the transport passage 55 is detached, and the wall surface portion 14*h* as a wall surface of the other transport passage provided in the apparatus main body 12 is exposed by the detachment. In addition, a spatial region, which has been occupied by the reversing unit 50, is formed in the apparatus main body 12. Accordingly, the operator can insert their hands from the formed spatial region and perform the jam processing as shown by an outlined arrow in the drawing while visually recognizing the sheet P brought into the jam state in the exposed transport passage 55 or in the opening portion 35. It is a matter of course that the operator inserts and attaches the reversing unit 50 to the apparatus main body 12 after the jam processing.

Moreover, the jam processing is performed for the sheet P brought into a jam state inside the extension unit 30 (sheet cassette 31) in some cases. In such cases, the operator lifts upward the apparatus main body 12 by holding the handhold portions formed by the first spatial region S1 and the second spatial region S2, which form a sequential spatial region in the vertical direction as shown in FIG. 6.

Since the movement of the apparatus main body 12 to the upward direction with respect to the extension unit 30 is always permitted as shown in FIG. 7, the operator lifts the apparatus main body 12 immediately after the occurrence of jam and detaches the extension unit 30 from the apparatus main body 12. As a result the opening 30*h* provided on the upper side of the extension unit 30 is exposed, and therefore, the operator inserts their hand into the sheet cassette 31 from the exposed opening 30*h* as shown by the outlined arrow in the drawing and removes the sheet P in the jam state in the sheet cassette 31. It is a matter of course that the sheet P brought into a jam state without being sent from the opening 35 to the transport passage 55 can be also removed since the apparatus main body 12 is detached from the upper side of the opening 35 in the extension unit 30 at the same time.

According to the above embodiment, the following effects can be achieved.

(1) It is possible to remove the sheet P in the jam state from the opening 35 by detaching the reversing unit 50 from the apparatus main body 12 even when the sheet P is brought into the jam state in the opening 35 communicating with the transport passage 56 in the apparatus main body 12 from the sheet cassette 31 for the sheet P in the extension unit 30. Accordingly, it is possible to easily perform the jam processing for the sheet P supplied from the extension unit 30.

(2) Since the sheet P sent from the extension unit 30 is transported to the transport passage 56 through the transport passage 55 configured by the reversing unit 50, it is possible to remove the sheet P in the jam state from the transport path by detaching the reversing unit 50 from the apparatus main body 12 even when the sheet P is brought into the jam state in the opening 35 or the transport passage 55. Accordingly, it is possible to easily perform the jam processing for the sheet P supplied from the extension unit 30.

(3) Since a detachable member is made to also function as the reversing unit 50, it is not necessary to separately prepare a detachable member. In addition, since the reversing unit 50 includes a region for reversing a sheet in the apparatus main body, it is possible to easily form a region for removing the sheet in the jam state in the apparatus main body 12 when the reversing unit 50 is detached.

(4) The state of the extension unit 30 attached to the apparatus main body 12 is stably maintained without displacement in a direction perpendicular to the direction in which the extension unit 30 is detached from the apparatus main body 12. On the other hand, since the displacement in the detachment direction, namely a direction opposite to the attachment direction, is always permitted, it is possible to immediately detach the extension unit 30 from the apparatus main body 12 every time the jam state occurs (without a particular operation of releasing lock, for example).

(5) The position of the connection terminal 64*a* is guided to an appropriate position by the guide protrusion 63 when the extension unit 30 is attached to the apparatus main body 12. Accordingly, electrical continuity can be reliably established between the extension unit 30 and the apparatus main body 12 when the extension unit 30 is detached for the jam processing and attached again.

(6) The convexed portions 61 and 62 can be easily fitted into the concaved portions 16*b* and 16*a* by the tapered portions 61*b* and 62*b* for starting the fitting, and movement in a direction perpendicular to the attachment direction is restricted since the cylindrical portions 61*a* and 62*a* other than the tapered portions 61*b* and 62*b* are fitted into the concaved portion 16*b* and 16*a* after the completion of the fitting. In addition, since movement in the direction opposite to the attachment direction is always permitted, it is possible to move the extension unit 30 in the direction opposite to the attachment direction and easily detach the extension unit 30 from the apparatus main body 12.

(7) Since the extension unit 30 is positioned with respect to the apparatus main body 12 by the convexed portions 61 and 62 provided at opposed positions with the gravity center G interposed therebetween, the extension unit 30 is attached to the apparatus main body 12 in a stable state where the displacement of the gravity center in the horizontal direction is suppressed.

(8) It is possible to form handhold portions with spatial regions (the first spatial region S1 and the second spatial region S2) which the operator can easily hold for lifting the apparatus main body 12 in the direction opposite to the weight direction in order to detach the extension unit 30 positioned on the side of the weight direction from the apparatus main body 12.

In addition, since the apparatus main body 12 is lifted at opposed positions with the gravity center interposed therebetween for lifting the apparatus main body 12 in the direction opposite to the weight direction, it is possible to easily lift the apparatus main body 12 in the right upward direction in a state where inclination with respect to the vertical direction is suppressed. Accordingly, it is possible to reduce the amount the apparatus main body 12 is lifted for separating the extension unit 30 from the apparatus main body 12 and to thereby easily detach the extension unit 30 from the apparatus main body 12.

(9) Since the fitting parts between the convexed portions 61 and 62 and the concaved portions 16*b* and 16*a* are formed near the handholds, it is possible to smoothly release the fitting state without prying open the fitting between the convex portions 61 and 62 and the concaved portions 16*b* and 16*a* when the apparatus main body 12 is lifted, for example.

In addition, the above embodiment can be modified as follows.

In the above embodiment, the reversing unit 50 may be configured to include at least a part of the opening 35 as a transport passage of the sheet P sent from the sheet cassette 31 in the extension unit 30 and configure a transport path connecting between the sheet cassette 31 and the transport passage 56. For example, the transport passage 55 may be configured to include the opening 35 in FIG. 3.

According to this modified example, the following effect in addition to the effects (3) to (9) in the above embodiment can be achieved.

(10) It is possible to remove the sheet P in the jam state from the transport path by detaching the reversing unit 50 configuring the transport path from the apparatus main body 12 even when the sheet P sent from the sheet cassette 31 provided in the extension unit 30 to the transport passage 56 of the apparatus main body 12 is brought into the jam state in the transport path connecting the sheet cassette 31 and the transport passage 56 in the apparatus main body 12. Accordingly, it is possible to easily perform the jam processing for the sheet P supplied from the sheet cassette 31 provided in the extension unit 30.

In the above embodiment, the shape of the concaved portions 16*a* and 16*b* are not limited to a penetrating hole shape and may be a cylindrical hole shape with a wall surface formed on the upper side.

In the above embodiment, the convexed portions 61 and 62 may be integrally formed with the upper cases 33 and 34 in the extension unit 30, respectively. Similarly, the contact portions 65*b* and 65*c* may be integrally formed with the upper case 33, and the contact portions 65*a* and 65*d* may be integrally formed with the upper case 34, respectively.

In the above embodiment, it is not necessary that the extension unit 30 be provided with the guide protrusion 63 for positioning the connection terminal. The guide protrusion 63 (and the concaved portion 16*c*) is not necessary in a configuration in which electrical continuity is established with the apparatus main body 12 by fitting between the convexed portions 61 and 62 and the concaved portions 16*a* and 16*b* when the extension unit 30 is attached to the apparatus main body 12.

In the above embodiment, it is not necessary that the convexed portions 61 and 62 be located near the handhold configuring portions 14*b* and 14*a* forming the first spatial region S1 in the horizontal direction in a state where the extension unit 30 is attached to the apparatus main body 12. For example, when the apparatus main body 12 can be easily lifted in the right upward direction without being inclined from the vertical direction, occurrence of prying open between the convexed portions 61 and 62 and the concaved portions 16*b* and 16*a* is suppressed. Accordingly, the concaved portion 16*a* may be formed at a position which does not overlap with the handhold configuring portion 14*b* in the front-back direction when viewed from the right, for example.

In the above embodiment, it is not necessary that the handhold configuring portions 14*b* and 14*a* forming the first spatial region S1 provided in a concaved manner in the apparatus main body 12 be provided at the opposed positions with the gravity center G of the projection shape of the lower portion 14*d*, to which the extension unit 30 is attached, in the weight direction interposed therebetween. For example, when the actual gravity center of the apparatus main body 12 is different from the gravity center G of the projection shape of the lower portion 14*d* in the weight direction, it is preferable that the handhold configuring portions 14*b* and 14*a* be formed at opposed positions with the actual gravity center of the apparatus main body 12 interposed therebetween.

In the above embodiment, the length W1 of the handhold configuring portion 14*b* in the front-back direction may be different from the length W2 of the handhold configuring portion 14*a* in the front-back direction. In so doing, the operator can correctly visually recognize the positions of the handhold configuration portion 33*a* and the handhold configuring portion 34*a* while lifting the apparatus main body 12 since the lengths of the handhold configuring portion 33*a* and the handhold configuring portion 34*a*, which respectively overlap with the handhold configuring portion 14*b* and the handhold configuring portion 14*a* in the vertical direction, in the front-back direction are different. As a result, it becomes easier to put the apparatus main body 12 on the extension unit 30 at the correct position.

In the above embodiment, it is not necessary that the extension unit 30 be provided with the second spatial region S2 when the handhold can be configured only with the first spatial region S1, for example.

In the above embodiment, it is not necessary that the positions at which the convexed portions 61 and 62 are formed be opposed positions with the gravity center G of the projection shape of the upper portion of the extension unit 30 in the direction opposite to the weight direction interposed therebetween. For example, both the convexed portions 61 and 62 may be formed at positions near the front ends of the upper surfaces of the upper cases 33 and 34 in the upper portion of the extension unit 30 or may be formed at positions near back ends of the upper surfaces.

In the above embodiment, the position at which the extension unit 30 is attached to the apparatus main body 12 is not necessarily limited to the side of the weight direction. For example, another configuration is also applicable in which the extension unit is attached thereto on the side of the horizontal direction.

In the above embodiment, the entire shape of the convexed portions 61 and 62 may be a cylindrical shape which does not necessarily include a tapered shape with a tapered leading end on the side of the attachment direction. It is possible to employ such convexed portions 61 and 62 with a cylindrical entire shape when the convexed portions 61 and 62 can be fitted into the concaved portions 16*a* and 16*b* while being guided by the chamfered portions, for example.

In the above embodiment, the convexed portions 61 and 62 may not be formed in the extension unit 30. The convexed portions 61 and 62 are not necessary in a configuration in which the displacement in the horizontal direction, namely the front-back and horizontal directions is restricted while the main body legs 69 attached to the lower surface of the lower portion 14*d* of the apparatus main body 12 are in contact with the upper cases 33 and 34 in the extension unit 30 when the apparatus main body 12 is stacked on the extension unit 30.

In the above embodiment, the recording apparatus 11 may not include a function for performing recording on both front and back sides of the sheet P. In such a case, the detachable member may be a member other than the reversing unit 50. In the case of a recording apparatus with a configuration in which the sheet P is not reversed, for example, a transport path forming member configuring the transport path may be provided at a part corresponding to the reversing unit 50 such that the transport path forming member can be attached and detached.

In the above embodiment, the medium is not limited to the sheet P and may be plate-shaped member made of a metallic plate, a resin plate, a cloth, or the like. That is, any member can be employed as the medium as long as the member can be transported and may be clogged in the transport path and brought into a jam state during the transportation.

In the above embodiment, the recording unit 20 may be an on-carriage type according to which the ink cartridge 27 is mounted on the carriage 24. Alternatively, the invention is not limited to a serial type printer according to which the carriage 24 is displaced in the main scanning direction and may be applied to a line-head type printer capable of printing characters in a range up to a sheet maximum width while the liquid ejecting head 25 is fixed.

In the above embodiment, the recording apparatus 11 may be an apparatus which does not include the image reading unit 13, or may be a multifunction machine provided with functions of a facsimile, a copy machine, and the like as well as the recording unit 20.

Although the invention was implemented as a liquid ejecting device which causes the recording unit 20 in the recording apparatus 11 to function as an ink-jet printer for ejecting ink as liquid in the above embodiment, the invention may be implemented as a liquid ejecting device which causes the recording unit 20 to ejects and discharges liquid other than ink. Various liquid ejecting devices each provided with a liquid ejecting head and the like for discharging a significantly small amount of liquid droplets may be used instead. In addition, the liquid droplets mean a state of liquid discharged from the liquid ejecting device and include granular droplets, tear-shaped droplets, and droplets with threadlike tails. In addition, the liquid described herein may be a material which can be ejected by the liquid ejecting device. For example, the liquid may be a substance in a liquid phase, fluid such as a liquid state substance with a high or low viscosity, sol, gel water, other inorganic solvent medium, organic solvent medium, solution, liquid resin, liquid metal (metallic melt), and the liquid is not limited to liquid as one state of a substance and includes solvent containing solid functional material such as pigment or metallic particles resolved and dispersed therein. Representative examples of the liquid include ink as described in the above embodiment, liquid crystal, and the like. Here, ink includes various liquid compositions such as general water-based ink, oil-based ink, gel ink, hot-melt ink, and the like. As a specific example of the liquid ejecting device, a liquid ejecting device can be exemplified which eject ink containing a material such as an electrode material, a colorant, or the like used in manufacturing a liquid crystal display, an EL (Electroluminescent) display, a surface-emitting display, or a color filter dispersed or resolved therein. Alternatively, a liquid ejecting device which ejects bioorganic substance to be used in manufacturing a biochip, a liquid ejecting device which is used as a precision pipette and ejects liquid as a sample, a textile printing device, a micro-dispenser and the like can be exemplified. Furthermore, a liquid ejecting device which exactly ejects lubricant oil to precision equipment such as a watch, a camera, or the like, a liquid ejecting device which ejects transparent resin liquid such as ultraviolet curable resin or the like onto a substrate to form a fine semi-sphere lens (optical lens) used in an optical communication element, a liquid ejecting device which ejects acid or alkaline etching liquid to etch a substrate or the like may be employed. In addition, the invention can be applied to any one of the above liquid ejecting devices.

The entire disclosure of Japanese Patent Application No. 2011-184951, filed Aug. 26, 2011 is expressly incorporated by reference herein.

What is claimed is:

1. A recording apparatus comprising:

an apparatus main body including a first placement portion on which a recording medium is placed, a recording unit which performs recording on the recording medium, and a first transport path through which the recording medium is transported from the first placement portion to the recording unit;

an extension unit including a second placement portion, which is detachably attached to the apparatus main body, on which the recording medium is placed, and a second transport path capable of communicating from the second placement portion to the first transport path of the apparatus main body; and a detachable member detachably provided in the apparatus main body and exposing at least a part of the second transport path when detached from the apparatus main body, wherein the detachable member configures a part of a third transport path connecting between the first transport path and the second transport path and exposes a part of the second transport path and the third transport path when detached from the apparatus main body, wherein the detachable member configures a part of the first transport path.

2. The recording apparatus according to claim 1, wherein the part of the first transport path configured by the detachable member has a curved shape.

3. The recording apparatus according to claim 2, wherein the part of the first transport path configured by the detachable member includes a reversing roller along the curved shape.

4. The recording apparatus according to claim 3, wherein the detachable member configures a part of a fourth transport path through which the recording medium after recording is performed by the recording unit is transported to the reversing roller, and wherein the recording medium transported from the fourth transport path is reversed by the reversing roller.

5. The recording apparatus according to claim 4, wherein the apparatus main body and the extension unit engage with each other by a plurality of concaved portions and convexed portions fitted into the concaved portions, and wherein relative displacement in a direction in which the extension unit is detached from the apparatus main body is permitted, and relative displacement in a direction perpendicular to the direction in which the extension unit is detached is restricted, between the concaved portions and the convexed portions in a state where the extension unit is attached to the apparatus main body.

6. The recording apparatus according to claim 5, wherein the extension unit is provided with a connection terminal establishing electrical continuity with the apparatus main body when attached to the apparatus main body and a guide protrusion, which is for positioning the connection terminal with respect to the apparatus main body, near the connection terminal.

7. A recording apparatus comprising:

an apparatus main body including a first placement portion on which a recording medium is placed, a recording unit which performs recording on the recording medium, and a first transport path through which the recording medium is transported from the first placement portion to the recording unit;

an extension unit including a second placement portion, which is detachably attached to the apparatus main body, on which the recording medium is placed, and a second transport path capable of communicating from the second placement portion to the first transport path of the apparatus main body; and an exposing member provided in the apparatus main body and exposing at least a part of the second transport path, wherein the exposing member configures a part of a third transport path connecting between the first transport path and the second transport path and exposes a part of the second transport path and the third transport path, wherein the exposing member configures a part of the first transport path.

8. The recording apparatus according to claim 7, wherein the exposing member exposes a part of the first transport path.

* * * * *